US008579398B2

(12) United States Patent
Kida

(10) Patent No.: US 8,579,398 B2
(45) Date of Patent: Nov. 12, 2013

(54) DROPLET DISCHARGE HEAD, DROPLET DISCHARGE APPARATUS, AND IMAGE FORMING APPARATUS

(75) Inventor: Hitoshi Kida, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 242 days.

(21) Appl. No.: 12/656,226

(22) Filed: Jan. 21, 2010

(65) Prior Publication Data

US 2010/0188448 A1 Jul. 29, 2010

(30) Foreign Application Priority Data

Jan. 27, 2009 (JP) ..... 2009-015560

(51) Int. Cl.
*B41J 29/38* (2006.01)

(52) U.S. Cl.
USPC ..... 347/9; 347/19; 347/5

(58) Field of Classification Search
USPC ..... 347/5, 9, 19, 12; 365/51
See application file for complete search history.

(56) References Cited

U.S. PATENT DOCUMENTS

| | | | | |
|---|---|---|---|---|
| 5,956,052 | A * | 9/1999 | Udagawa et al. | 347/19 |
| 6,208,546 | B1 * | 3/2001 | Ikeda | 365/51 |
| 6,271,928 | B1 | 8/2001 | Bullock et al. | |
| 6,588,872 | B2 * | 7/2003 | Anderson et al. | 347/19 |
| 6,948,789 | B2 * | 9/2005 | Imanaka et al. | 347/9 |

FOREIGN PATENT DOCUMENTS

| | | |
|---|---|---|
| JP | 62-162141 | 7/1987 |
| JP | 62-278650 | 12/1987 |
| JP | 05-108380 | 4/1993 |
| JP | 06-040086 | 2/1994 |
| JP | 07-171955 | 7/1995 |
| JP | 08-281927 | 10/1996 |
| JP | A-11-314377 | 11/1999 |
| JP | A-2002-127460 | 5/2002 |
| JP | 2003-237045 | 8/2003 |
| JP | 2004-164632 | 6/2004 |
| JP | 2005-108273 | 4/2005 |
| JP | 2007-164622 | 6/2007 |

OTHER PUBLICATIONS

Dec. 11, 2012 Japanese Office Action issued in Japanese Application No. 2009-015560.

* cited by examiner

*Primary Examiner* — Lam S Nguyen
(74) *Attorney, Agent, or Firm* — Harness, Dickey & Pierce

(57) ABSTRACT

A droplet discharge head includes circuit boards each mounted with one or more nonvolatile memories. The nonvolatile memories are configured in a data-rewritable manner and are used to store written data even when power is turned off. The nonvolatile memories have a write-protect function. One or more of the nonvolatile memories are set to write inhibition state and the write inhibition state is fixed. One or more of the remaining nonvolatile memories are set to rewritable state.

18 Claims, 4 Drawing Sheets

DROPLET DISCHARGE HEAD, DROPLET DISCHARGE APPARATUS, AND IMAGE FORMING APPARATUS

CROSS-REFERENCE TO RELATED APPLICATIONS

The present application claims priority to and incorporates by reference the entire contents of Japanese Patent Application No. 2009-015560 filed in Japan on Jan. 27, 2009.

BACKGROUND OF THE INVENTION

1. Field of the Invention

The present invention relates to droplet discharge heads, for example inkjet heads or the like, droplet discharge apparatuses, and image forming apparatuses provided therewith. More particularly, the present invention relates to droplet discharge heads provided with a memory for storing data.

2. Description of the Related Art

A droplet discharge head and a droplet discharge apparatus provided therewith are described below by using an inkjet print head and an inkjet printer provided therewith. In the inkjet print head, nozzle variation occurs in the same head as well as among the heads. Accordingly, to perform printing uniformly and at high precision, it is necessary to reduce the nozzle variation. This can be achieved by individually setting a profile, such as a driving waveform, for each head.

However, a heavy-duty and speedy inkjet printer, which performs volumes of printing at high speed, has many inkjet print heads. For example, such printers may have several hundred heads. With such a vast number of heads, it is impractical to manually set the profile for each head. To solve this problem, in some printers a nonvolatile memory is mounted on each head. A profile, such as setting information on the driving waveform that agrees with each of the heads, is written in the nonvolatile memory in advance, and when the head is mounted on the printer, the profile is read from the nonvolatile memory. As a result, a driving condition, such as the driving waveform that agrees with the head, is automatically set for each head by the printer. A related technology has been disclose in, for example, Japanese Patent Application Laid-open No. H7-171955 and Japanese Patent Application Laid-open No. 2003-237045.

Damage to the contents stored in the nonvolatile memory, such as basic information on the head, e.g., the profile such as the setting information on the driving waveform or a head individual number, needs to be avoided. From this view point, read-only PROMs or EPROMs are preferably used as the nonvolatile memory.

By aiming at controlling a characteristic change in the head or service life of the head, there is a strong demand for storing the number of times a pressure generating element is driven, the number of times a surface of a nozzle is cleaned by a wiper, operation hours, or the like (for example, Japanese Patent Application No. H5-108380 and Japanese Patent Application Laid-open No. H8-281927). To meet these demands, when a rewritable EEPROM or flash memory is used as a nonvolatile memory, the risk of damage due to an unexpected incident affecting the basic information about the head, which should not be deleted, is higher compared with a case where a read-only nonvolatile memory is used. Such unexpected incidents include a specification error in an address for writing data, a handling error, an extreme low-voltage state when turning a power supply on or off, a control error, noise, or the like.

To cope with such a problem, conventionally, a read-only ROM and a rewritable RAM are separately mounted. Basic information that should not be deleted is written in the ROM, and information that needs to be rewritten is written in the RAM (for example, Japanese Patent Application Laid-open No. H6-40086).

In recent years, as the density of the nozzles on inkjet heads has increased, an inkjet head with a structure in which a plurality of nozzle rows with the same structure are arranged to form a single head has become popular. A head in which each of the nozzle rows with the same structure includes a circuit board mounted with a nozzle selecting element is widely used. Similar to the conventional technology, it is conceivable that both a read-only nonvolatile memory and a rewritable nonvolatile memory are mounted on the same board; however, costs increase if the read-only nonvolatile memories and the rewritable nonvolatile memories are each mounted on all of the boards.

It is also conceivable that two types of board are used: a board mounted with both the read-only nonvolatile memory and the rewritable nonvolatile memory and a board without mounting the nonvolatile memory even though the same type of board is used. However, the unit price of parts cannot be reduced due to a decrease in order quantity of the boards, and, moreover, the stock control is complicated. It is also conceivable that, instead of mounting a nonvolatile memory on the same board equipped with the nozzle row with the same structure, the boards with the same structure equipped with the nozzle rows with the same structure are connected to another second board all together, on which both the read-only nonvolatile memory and the rewritable nonvolatile memory are mounted. In such a case, two types of board also need to be prepared; therefore, the cost is increased and stock control becomes complicated.

Among EEPROMs, there is a type of, for example, 25LC040 manufactured by Microchip Technology, Inc., having a read-only address space and a rewritable address space in a single device; however, in such a device, the write-protected area is small and the device is not I2C bus type, which causes a problem in that the choice of EEPROM is limited.

A method of arranging a controller and setting a read-only memory block and a rewritable memory block has been proposed in, for example, Japanese Patent Application Laid-open No. 2004-164632, Japanese Patent Application Laid-open No. 2005-108273, and Japanese Patent Application Laid-open No. S62-278650. With this method, although it is possible to cope with a specification error in an address for writing data or a handling error, there sometimes is a case of not being able to cope with damage to data due to noise or the like, and, moreover, design is complicated because a controller for the memories needs to be arranged.

A method in which a controller and a plurality of types of memories are arranged and non-rewritable data and data to be rewritten are determined for storage therein is proposed (for example, Japanese Patent Application Laid-open No. S62-162141); however, because it is necessary to install a controller for the memories, the design is also complicated.

A method of, when data is written, disconnecting a wiring line of a memory, which stores data to be protected, with a switch is proposed (for example, Japanese Patent Application Laid-open No. 2007-164622). With this method, the cost of providing the switch is required, and moreover, the design is complicated because a controller for the switch needs to be arranged.

SUMMARY OF THE INVENTION

It is an object of the present invention to at least partially solve the problems in the conventional technology.

According to an aspect of the present invention, there is provided a droplet discharge head including a plurality of circuit boards; and a plurality of nonvolatile memories mounted on the circuit boards and configured in a data-rewritable manner for data related to the droplet discharge head and that is used to store written data even when power is turned off. The nonvolatile memories having a write-protect function. Among the nonvolatile memories, a nonvolatile memory in singularity or plurality constituting a first nonvolatile memory is set to write inhibition state and the write inhibition state is fixed. Among the nonvolatile memories, other nonvolatile memory in singularity or plurality constituting a second nonvolatile memory is set to rewritable state.

According to another aspect of the present invention, there is provided a droplet discharge head including a plurality of circuit boards; a plurality of nonvolatile memories mounted on the circuit boards and configured in a data-rewritable manner for data related to the droplet discharge head and that is used to store written data even when power is turned off; and a setting unit that sets, among the nonvolatile memories, a nonvolatile memory in singularity or plurality constituting a first nonvolatile memory to write inhibition state and fixes the write inhibition state, and among the nonvolatile memories, other nonvolatile memory in singularity or plurality constituting a second nonvolatile memory to rewritable state.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described with reference to the drawings. The present invention is not limited to these embodiments.

Figure 1:
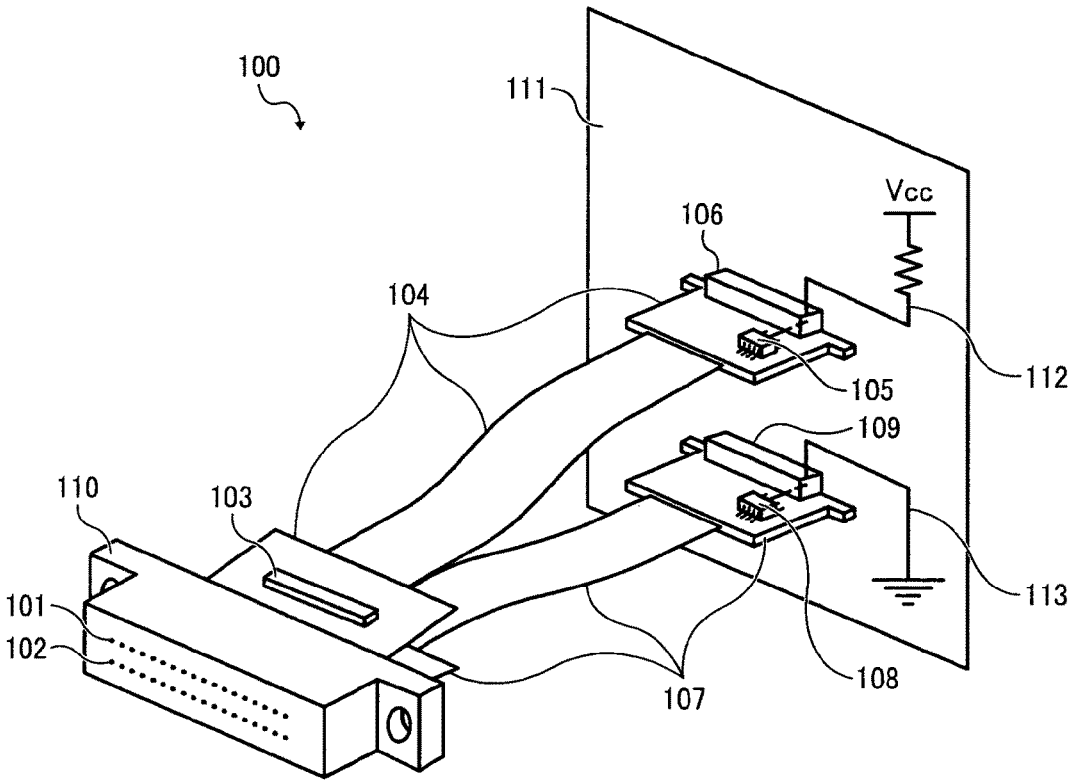
FIG. 1 is a perspective view of an inkjet head according to a first embodiment of the present invention.

FIG. 1 is a perspective view of an inkjet head 100 according to a first embodiment of the present invention. The inkjet head 100 includes a first nozzle row 101 and a second nozzle row 102. Each of the first nozzle row 101 and the second nozzle row includes a plurality of nozzles arranged in a line. A board 104 is mounted with a nozzle selecting element 103 that controls the first nozzle row 101, and the board 104 is connected, inside a housing 110, to a pressure generating element (not shown) that drives nozzles of the first nozzle row 101. A rewritable nonvolatile memory 105 is mounted on the board 104, and a wiring line to the nonvolatile memory 105 runs to a head connecting board 111 via a connector 106.

Similarly, for the second nozzle row 102, a board 107 mounted with a nozzle control element (not shown) that controls the second nozzle row 102 is connected, inside the housing 110, to a pressure generating element (not shown) that drives nozzles of the second nozzle row 102. A rewritable nonvolatile memory 108 is mounted on the board 107, and a wiring line to the nonvolatile memory 108 runs to the head connecting board 111 via a connector 109. The board 104 and the board 107 have the same configuration, i.e., they have the same circuit pattern and they are formed with the same material.

A wiring line 112 running from a write-protect setting terminal in the nonvolatile memory 105 is connected to a logic power supply (Vcc) arranged on the head connecting board 111 so that the write-protect setting terminal is fixed at a HIGH logical level. On the other hand, a wiring line 113 running from a write-protect setting terminal in the nonvolatile memory 108 is connected to ground arranged on the head connecting board 111 so that the write-protect setting terminal is set to a LOW logical level.

Figure 2:
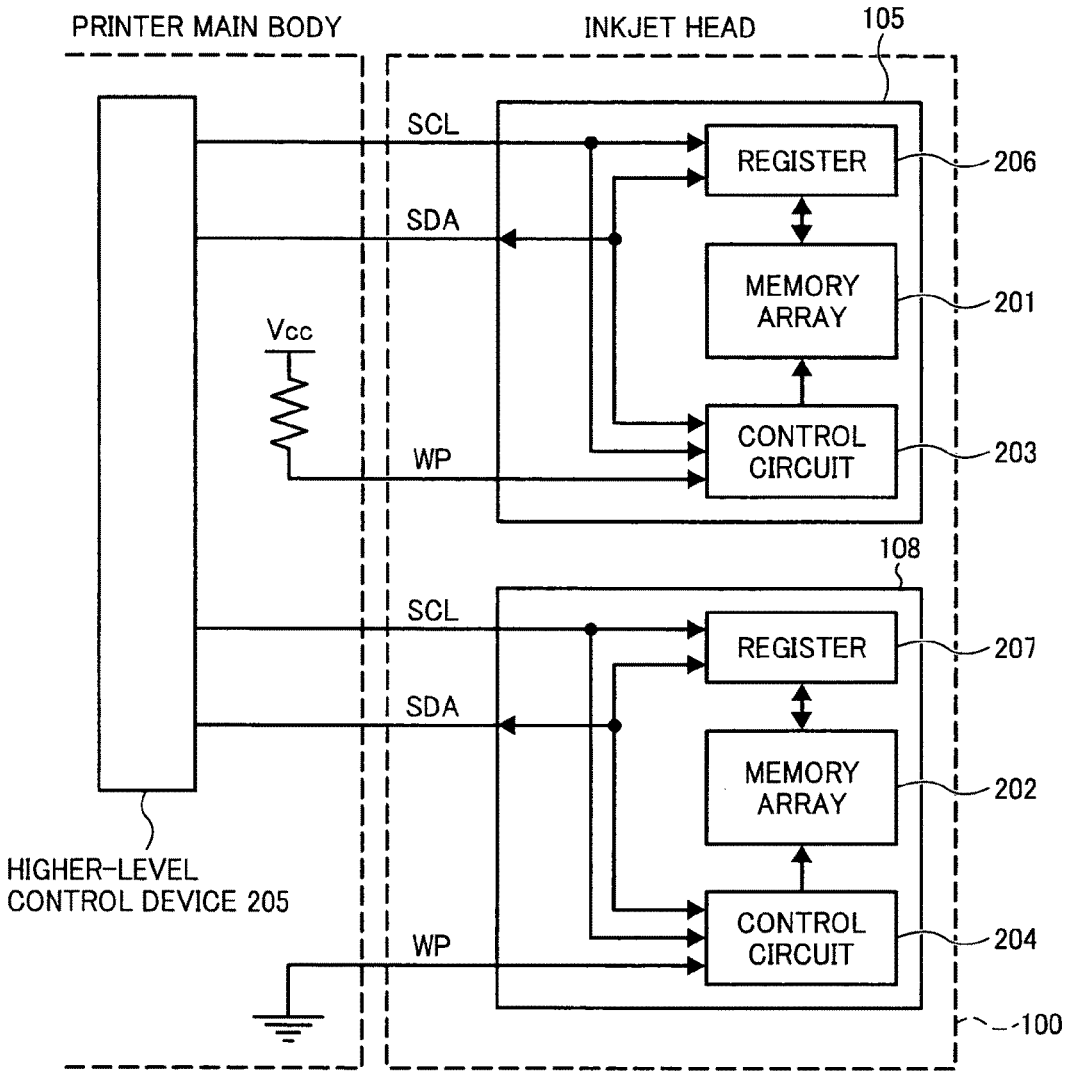
FIG. 2 is a block diagram for explaining an operating principle of a memory.

Functions of the nonvolatile memories 105 and 108 are described with reference to the block diagram in FIG. 2. The nonvolatile memories 105 and 108 include memory arrays 201 and 202, control circuits 203 and 204, and registers 206 and 207, respectively. The control circuits 203 and 204 control read/write of data in the memory arrays 201 and 202. The control circuits 203 and 204 control reading/writing of data between a higher-level control device 205 and the memory arrays 201 and 202. Registers 206 and 207 count up when data is read/written between the higher-level control device 205 and the memory arrays 201 and 202 by using a clock signal SCL and a data signal SDA.

WP are write-protect terminals. When the terminals WP are connected to Vcc (collector output) or Vdd (drain output), and if the signal level is HIGH, writing is prohibited and reading only is allowed. On the other hand when the terminals WP are connected to GND (ground) or Vss (source output), and if the signal level is LOW, both writing and reading are prohibited. It should be noted that, it can be opposite of this.

The nonvolatile memory 105, whose write-protect setting terminal is set to the HIGH logical level, acts as a read-only memory and it is controlled by the control circuit 203. The nonvolatile memory 108, whose write-protect setting terminal is set to the LOW logical level, acts as a readable/writable memory and it is controlled by the control circuit 204.

With the above-described configuration, it is possible for the inkjet head 300 to serve as the same function as one having both a read-only nonvolatile memory and a rewritable nonvolatile memory even though separate boards with the same structure are used and simply one memory is mounted on each board.

It is not mandatory to connect the wiring line 113 running from the write-protect setting terminal in the nonvolatile memory 108 to the ground so as be fix it in a writable state. In another exemplary configuration, the wiring line 113 is connected to a control line of the higher-level control device 205 so as to set the write-protect setting terminal in the nonvolatile memory 108 to the HIGH/LOW logical level. The write-protect setting terminal is usually set to the HIGH logical level to use the nonvolatile memory 108 as a read-only memory and it is set to the LOW logical level only when data needs to be written to the nonvolatile memory 108. This approach leads to increase in the performance of protecting data stored in the nonvolatile memory 108.

Important data that need not be rewritten and also causes problems if the data is deleted, such as a unique number of the head (identification information of the head), unique driving conditions, or the like, is stored in the nonvolatile memory 105, and data that needs to be rewritten as required, such as the number of times the head is driven or cleaned, is stored in the nonvolatile memory 108. This can implement both the protection of basic data that need not be rewritten and the function of writing data.

Figure 3:
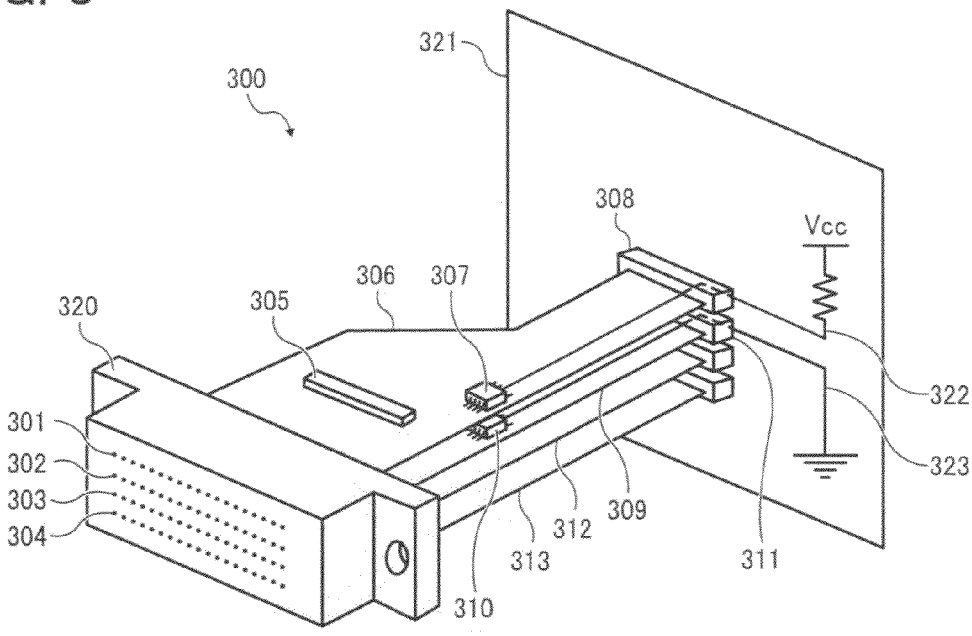
FIG. 3 is a perspective view of an inkjet head according to a second embodiment of the present invention.

FIG. 3 is a perspective view of an inkjet head 300 according to a second embodiment of the present invention. The inkjet head 300 includes a first nozzle row 301, a second nozzle row 302, a third nozzle row 303, and a fourth nozzle row 304. A board 306 mounted with a nozzle selecting element 305 that controls the first nozzle row 301 is connected, inside a housing 320, to a pressure generating element (not shown) that drives nozzles of the first nozzle row 301. A rewritable nonvolatile memory 307 is mounted on the board 306, and a wiring line to the nonvolatile memory 307 runs to a head connecting board 321 via a connector 308.

For the second nozzle row 302, a board 309 mounted with a nozzle control element (not shown) that controls the second nozzle row 302 is connected, inside the housing 320, to a pressure generating element (not shown) that drives nozzles of the second nozzle row 302. A rewritable nonvolatile memory 310 is mounted on the board 309, and a wiring line to the memory 310 runs to the head connecting board 321 via a connector 311.

Similarly, for the third nozzle row 303, a board 312 mounted with a nozzle control element (not shown) that controls the third nozzle row 303 is connected, inside the housing 320, to a pressure generating element (not shown) that drives nozzles of the third nozzle row 303. A rewritable nonvolatile memory is not mounted on the board 312.

Similarly, for the fourth nozzle row 304, a board 313 mounted with a nozzle control element (not shown) that controls the fourth nozzle row 304 is connected, inside the housing 320, to a pressure generating element (not shown) that controls nozzles of the fourth nozzle row 304. A rewritable nonvolatile memory is not mounted on the board 313.

The boards 306, 309, 312, and 313 have the same structure, i.e., they have the same circuit pattern and they are formed with the same material. The difference between the boards 306 and 309 and the boards 312 and 313 is whether the memory is mounted thereon.

A wiring line 322 running from a write-protect setting terminal in the nonvolatile memory 307 is connected to a logic power supply (Vcc) on the head connecting board 321 and thereby fixing the nonvolatile memory 307 at a HIGH logical level. Thus, the nonvolatile memory 307 acts as a read-only memory.

A wiring line 323 running from a write-protect setting terminal in the nonvolatile memory 310 is connected to the ground on the head connecting board 321 thereby setting the nonvolatile memory 310 to a LOW logical level. Thus, the nonvolatile memory 310 acts as a readable/writable memory.

With the above-described configuration, compared with the configuration in FIG. 1, although two types of board, i.e., one having a memory and the other one not having a memory, need to be prepared, it is possible for the inkjet head 300 to serve as the same function as one having both a read-only nonvolatile memory and a rewritable nonvolatile memory, even though the boards with the same structure are used simply by mounting a single memory on each board, which makes it possible to implement both the protection of basic data that need not be rewritten and the function of writing data.

It is not mandatory to connect the wiring line 323 running from the write-protect setting terminal in the nonvolatile memory 310 to the ground so as be fix it in a writable state. In another exemplary configuration, the wiring line 323 is connected to a control line of a higher-level control device so as to set the write-protect setting terminal in the nonvolatile memory 310 to the HIGH/LOW logical level. The write-protect setting terminal is usually set to the HIGH logical level to use the nonvolatile memory 310 as a read-only memory and it is set to the LOW logical level only when data needs to be written to the nonvolatile memory 310. This approach leads to increase in the performance of protecting data stored in the nonvolatile memory 310.

Important data that need not be rewritten and also causes problems if the data is deleted, such as a unique number of the head (identification information of the head), unique driving conditions, or the like, is stored in the nonvolatile memory 307, and data that needs to be rewritten as required, such as the number of times the head is driven or cleaned, is stored in the nonvolatile memory 310. This can implement both the protection of basic data that need not be rewritten and the function of writing data.

In another exemplary configuration, memories are mounted on both the board 312 and the board 313, in a similar manner as in the first embodiment described using FIG. 1. With this approach, it is possible to eliminate the complication of preparing two types of boards and to reduce the unit price due to an increase in order quantity of the same type of board, thus advantageously simplifying stock control and the assembly process.

In still another exemplary configuration, memories are mounted on even the board 312 and the board 313, and the memory mounted on the board 306 is used as a read-only memory and the memories mounted on the boards 309, 312, and 313 are used as readable/writable memories. Alternatively, the memories mounted on the boards 306 and 309 are used as read-only memories, and the memories mounted on the boards 312 and 313 are used as readable/writable memories. In this way, the capacity of the read-only memory and the capacity of the readable/writable memory can be made to increase/decrease according to the setting, which results in an advantage in that it is possible to flexibly cope with the various kinds of operation methods using different memory capacities.

Figure 4:
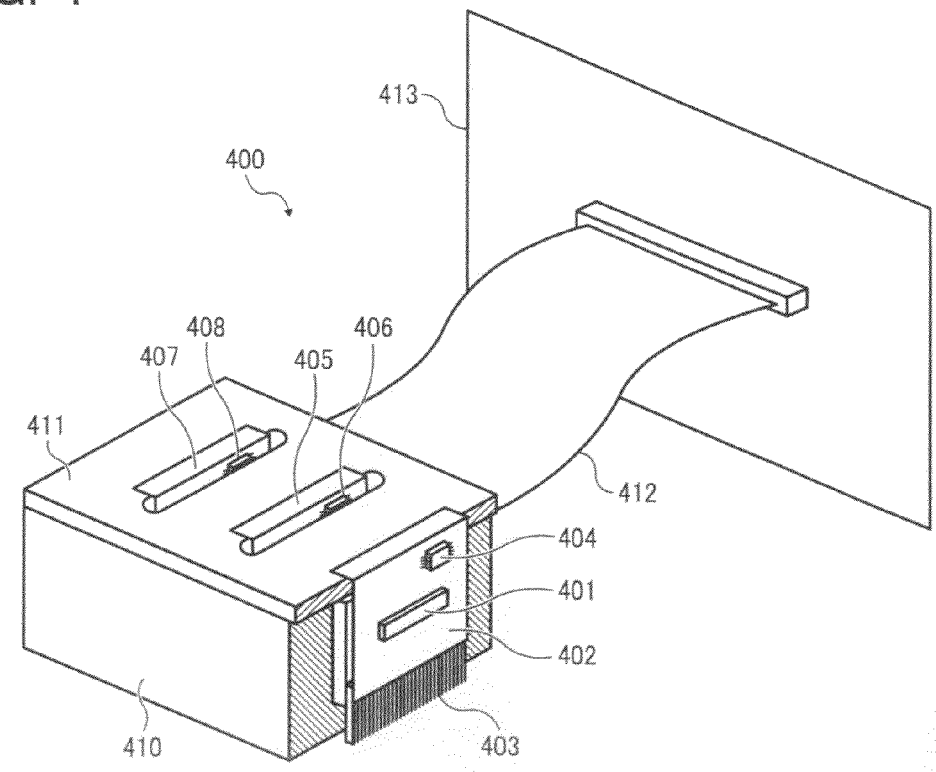
FIG. 4 is a perspective view of an inkjet head according to a third embodiment of the present invention.

FIG. 4 is a perspective view of an inkjet head 400 according to a third embodiment of the present invention. The inkjet head 400 includes a first nozzle row, a second nozzle row, and a third nozzle row (all not shown). A board 402 mounted with a nozzle selecting element 401 that controls the first nozzle row is connected, inside a housing 410, to a pressure generating element 403 that drives nozzles of the first nozzle row. A rewritable nonvolatile memory 404 is mounted on the board 402.

For the second nozzle row, a board 405 mounted with a nozzle control element (not shown) that controls the second nozzle row is connected, inside the housing 410, to a pressure generating element (not shown) that drives nozzles of the second nozzle row. A rewritable nonvolatile memory 406 is mounted on the board 405.

For the third nozzle row, a board 407 mounted with a nozzle control element (not shown) that controls the third nozzle row is connected, inside the housing 410, to a pressure generating element (not shown) that drives nozzles of the third nozzle row. A rewritable nonvolatile memory 408 is mounted on the board 407.

The boards 402, 405, and 407 are connected to a relay board 411 by soldering or using ACF connection technology, and then connected to a head connecting board 413 via a flexible flat cable 412. The boards 402, 405, and 407 used here have the same circuit pattern and material.

A wiring line running from a write-protect setting terminal in the nonvolatile memory 404 is connected to a logic power supply (Vcc) on the board 402, or the relay board 411, or the head connecting board 413 so that the write-protect setting terminal is fixed at a HIGH logical level. Thus, the nonvolatile memory 404 acts as a read-only memory.

A wiring line running from a write-protect setting terminal in the nonvolatile memory 406 is connected to the ground on the board 405, or the relay board 411, or the head connecting board 413 so that the write-protect setting terminal is set to a LOW logical level. Thus, the nonvolatile memory 406 acts as a readable/writable memory.

A wiring line running from a write-protect setting terminal in the nonvolatile memory 408 is connected to the ground on the board 407, or the relay board 411, or the head connecting board 413 so that the write-protect setting terminal is set to a LOW logical level. Thus, the nonvolatile memory 408 acts as a readable/writable memory.

With the above-described configuration, compared with the configuration in FIG. 1, although more components are required, it is possible for the inkjet head 400 to serve as the same function as one having both a read-only nonvolatile memory and a rewritable nonvolatile memory even though the boards with the same structure are used simply by mounting a single memory on each board, which makes it possible to implement both the protection of basic data that need not be rewritten and the function of writing data.

It is not mandatory to connect the wiring lines running from the write-protect setting terminals in the memories 406 and 408 to the ground so as be fix them in a writable state. In another exemplary configuration, the wiring lines are connected to control lines of the higher-level control device so as to set the write-protect setting terminals in the memories 406 and 408 to the HIGH/LOW logical level. The write-protect setting terminals are usually set to the HIGH logical level to use the nonvolatile memory 406 or 408 as a read-only memory and they are set to the LOW logical level only when data needs to be written to the nonvolatile memory 406 or 408. This approach leads to increase in the performance of protecting data stored in the nonvolatile memory 406 or 408.

Important data that need not be rewritten and also causes problems if the data is deleted, such as a unique number of the head (identification information of the head), unique driving conditions, or the like, is stored in the nonvolatile memory 404, and data that needs to be rewritten as required, such as the number of times the head is driven or cleaned, is stored in the nonvolatile memory 406 or 408. This can implement both the protection of basic data that need not be rewritten and the function of writing data.

As described in the above embodiments, the wiring line from the write-protect setting terminal in the memory to which the inkjet head is connected is connected to the logic power supply (Vcc) or to the ground in order to set the nonvolatile memory mounted on the board to read-only or readable/writable. It is preferable to use the same type of inkjet head for various kinds of image forming apparatuses using different types of memories; however, the configuration is not limited thereto. For example, the nonvolatile memory mounted on the board can be set to read-only or readable/writable by connecting, on the head side, the wiring line from the write-protect setting terminal in the memory to the logic power supply (Vcc) or to the ground. The method thereof is described with reference to FIG. 5 as a fourth embodiment of an inkjet head 500 according to the present invention.

In the inkjet head 500, a board 502 mounted with a nozzle selecting element 501 that controls a nozzle row (not shown) is connected, inside a housing 503, to a pressure generating element (not shown) that drives nozzles of the nozzle row. A wiring line 505 that is connected to the logic power supply when a terminal 504 is connected to a head connecting board (not shown) and a wiring line 506 that is connected to the ground when the terminal 504 is connected to the head connecting board are wired in the nozzle selecting element 501.

A rewritable nonvolatile memory 507 is mounted on the board 502. A write-protect setting terminal in the nonvolatile memory 507 can be connected to the wiring line 505 that is connected to the logic power supply at a connecting device 508 such as a switch or a jumper, and the wiring line 506 that is connected to the ground at a connecting device 509 such as a switch or a jumper. There is a plurality of nozzle rows, each of which has the same board as the board 502.

Figure 5:
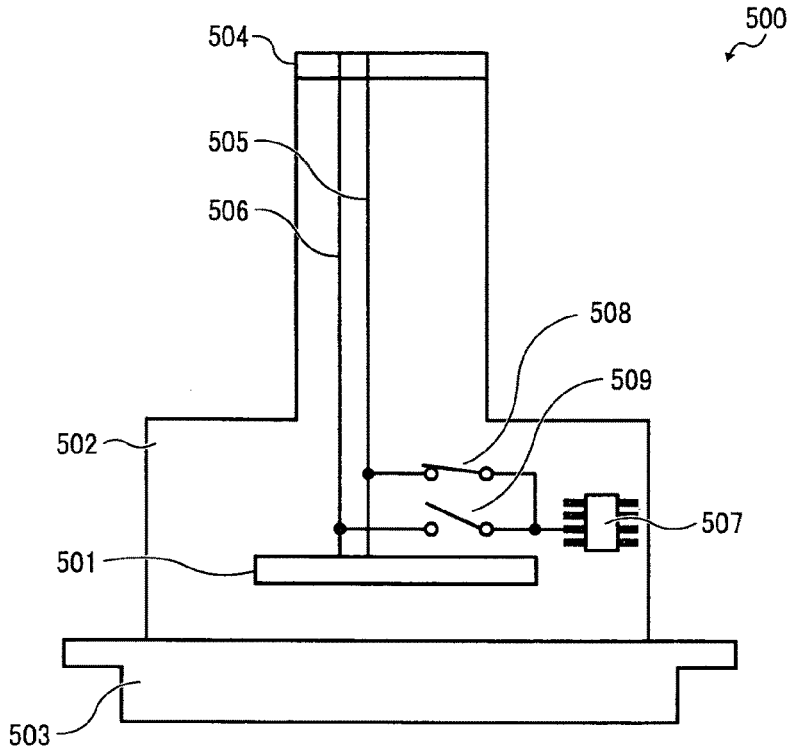
FIG. 5 is a schematic view of an inkjet head according to a fourth embodiment of the present invention.

As shown in FIG. 5, when the connecting device 508 is in a connected state and the connecting device 509 is in a disconnected state, the write-protect setting terminal in the nonvolatile memory 507 is fixed at HIGH level and the nonvolatile memory 507 acts as a read-only memory. In contrast, when the connecting device 508 is in a disconnected state and the connecting device 509 is in a connected state, the write-protect setting terminal in the nonvolatile memory 507 is set to LOW level and the nonvolatile memory 507 acts as a readable/writable memory.

By individually setting each of the nonvolatile memories 507 mounted on one of the corresponding boards 502 to either a read-only memory or a readable/writable memory, it is possible for the inkjet head to serve as the same function as one having both a read-only nonvolatile memory and a rewritable nonvolatile memory; therefore, both the protection of basic data that need not be rewritten and the function of writing data can be implemented. In addition, important data that need not be rewritten and also causes problems if the data is deleted, such as a unique number of the head, unique driving conditions, or the like, is stored in the memory that is set to read-only, and data that needs to be rewritten as required, such as the number of times the head is driven or cleaned, is stored in the memory that is set to readable/writable. This can implement both the protection of the basic data that need not be rewritten and the function of writing data.

With the inkjet head 500, because a plurality of nonvolatile memories is mounted on each of the heads, the required number of I/O ports for reading/writing from/to the memory tends to increase; however, by using memory capable of assigning addresses to the memories, such as an EEPROM with an I2C bus type, reading/writing from/to a plurality of memories is possible using a single I/O port, thus making up for such a drawback.

Figure 6:
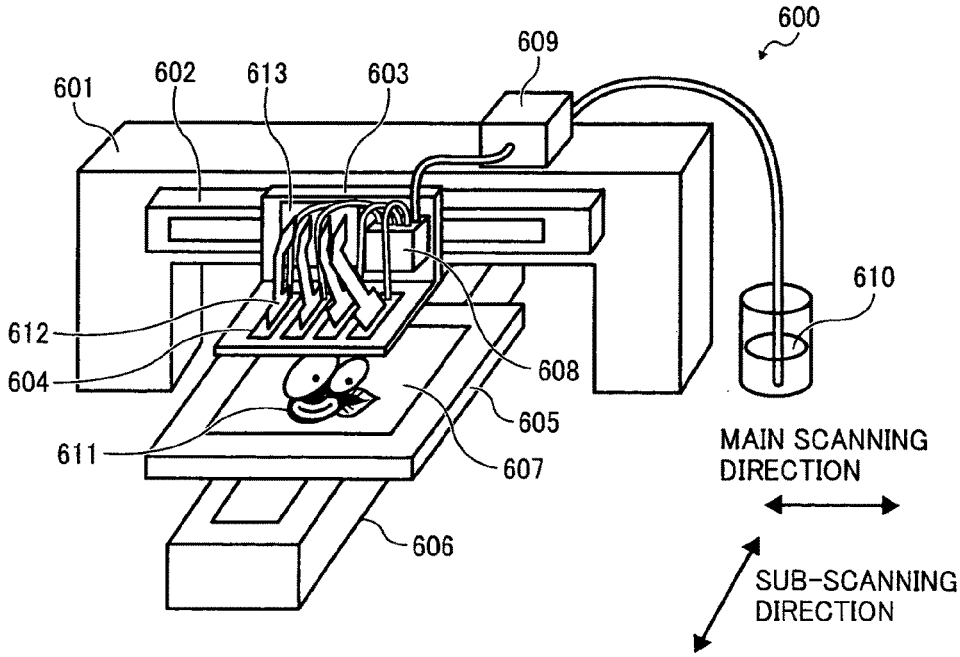
FIG. 6 is a perspective view of an image forming apparatus including an inkjet head according to a fifth embodiment of the present invention.

FIG. 6 is a perspective view illustrating an image forming apparatus 600 including an inkjet head according to a fifth embodiment of the present invention.

In the image forming apparatus 600, as shown in FIG. 6, an X-axis linear-motion guide 602 is arranged on a gantry arm 601, and a plurality of inkjet heads 604 is attached to a head base 603 that is attached to the X-axis linear-motion guide 602. The inkjet heads 604 are movable in the main-scanning direction (the X-axis direction). A stage 605 is arranged on a Y-axis linear-motion guide 606, and a medium 607 placed on the stage 605 is movable in the sub-scanning direction (the Y-axis direction) that is orthogonal to the main-scanning direction.

Ink is supplied to the inkjet heads 604 from a sub ink tank 608. The pressure in the sub ink tank 608 is always reduced to an optimum pressure by a negative-pressure-controller and ink-supply-pump 609, thus preventing the ink from leaking out through the nozzles. If the remaining ink level in the sub ink tank 608 is low, ink is supplied from a main ink tank 610 by the negative-pressure-controller and ink-supply-pump 609.

By moving the inkjet heads 604 in the main-scanning direction using the X-axis linear-motion guide 602, ink is discharged from the inkjet heads 604 toward the medium 607 in response to a control signal, thus forming a desired image on the medium 607. After moving the medium 607 in the sub-scanning direction by a predetermined amount using the Y-axis linear-motion guide 606, while again moving the inkjet heads 604 in the main-scanning direction using the X-axis linear-motion guide 602, the ink is discharged from the inkjet heads 604 toward the medium 607 in response to the control signal, thus forming a desired image on the medium 607. By repeating this process, a desired image 611 is formed on the medium 607.

Any one of the inkjet heads 300, 400, and 500 and be used as the inkjet head 604. Boards 612 connected to a pressure generating element (not shown) are connected to a head connecting board 613. A nonvolatile memory (not shown) is mounted on each of the boards 612, and a write-protect setting terminal in the nonvolatile memory is set to HIGH/LOW on the head connecting board 613; therefore, a read-only memory and a readable/writable memory are set.

At the commencement of the operation, using a higher-level control device (not shown), the driving condition such as a driving voltage is automatically set in each head by reading characteristic data of each of the heads written in the memory, which is set to be the read-only memory, arranged in each of the heads. At the end of the operation, using the higher-level control device (not shown), the power supply is turned off after storing data, such as the maximum number of times the pressure generating element of each head is driven, operating hours of the pressure generating element of each head, the number of times a surface of the nozzle is cleaned by a wiper, or the like, in the memory that is set to be a readable/writable memory arranged in each of the heads. When a head reaches its life in terms of the maximum number of times the pressure generating element is driven, operating hours of the pressure generating element, and the number of times a surface of the nozzle is cleaned by the wiper, a sign prompting an operator to change the head is displayed.

The image forming apparatus that includes the inkjet head according to the present invention is not limited to the configuration shown in FIG. 6. For example, it is possible to apply the inkjet head and a mechanism, such as reading/writing data to the memory or automatic setting of the driving condition, according to the present invention to the overall configuration of known image forming apparatuses that use inkjet heads.

The boards with the same structure as the above embodiments can be used so long as the boards are connected to pressure generating elements each corresponding to the plurality of nozzle rows. The present invention can be basically implemented even when a nozzle selecting element is not mounted, a board pattern slightly differs, different parts are mounted, and so on.

The embodiment has been described by way of example of a memory in which write inhibition is set by setting the write-protect setting terminal at HIGH level; however, the present invention is not limited thereto, so long as it conforms to the specification of the memory for use in terms of a method of setting write inhibition.

Because the present invention can reliably provide an image forming apparatus capable of setting a driving condition for each head, it is preferable for a wide printer, which includes many inkjet heads, operated in a plant or the like where a lot of noise is produced.

According to an aspect of the present invention, it is possible to implement the same function as one having both a read-only nonvolatile memory and a rewritable nonvolatile memory without arranging a special memory controller and without both arranging a read-only nonvolatile memory and a rewritable nonvolatile memory.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A droplet discharge head comprising:

a plurality of circuit boards; and a plurality of nonvolatile memories mounted on the circuit boards and configured in a data-rewritable manner for data related to the droplet discharge head and that is configured to store written data even when power is turned off, wherein, the nonvolatile memories have a write-protect function, the plurality of circuit boards includes at least a first circuit board and a second circuit board, each of the first and the second circuit boards has a same circuit pattern, and is made of a same material, the first circuit board includes a first nonvolatile memory, and the second circuit board includes a second nonvolatile memory, the first nonvolatile memory is set to write inhibition state, and fixed as a read only nonvolatile memory, and the second nonvolatile memory is set to rewritable state.

2. The droplet discharge head according to claim 1, wherein the first nonvolatile memory is a read-only nonvolatile memory for data that should not be deleted and need not be rewritten, and the second nonvolatile memory is a read/write nonvolatile memory for data that is rewritten as required.

3. The droplet discharge head according to claim 1, wherein the nonvolatile memory is a nonvolatile memory in which a plurality of elements can be connected to a single I/O port.

4. The droplet discharge head according to claim 1, wherein the second nonvolatile memory is configured in either one of a rewritable manner and a manner in which the write inhibition state is fixable.

5. A droplet discharge apparatus comprising the droplet discharge head according to claim 1.

6. An image forming apparatus comprising the droplet discharge apparatus according to claim 5.

7. The droplet discharge head according to claim 1, further comprising:

a connecting device configured to switch to perform setting and fixing the first nonvolatile memory to the write inhibition state.

8. The droplet discharge head according to claim 1, wherein each of the first circuit board and the second circuit board is connected to a pressure generating element that drives nozzles of the droplet discharge head.

9. The droplet discharge head according to claim 1, wherein each of the first circuit board and the second circuit board is mounted with a nozzle selecting element that controls a nozzle row of the droplet discharge head.

10. A droplet discharge head comprising:

a plurality of circuit boards;

a plurality of nonvolatile memories mounted on the circuit boards and configured in a data-rewritable manner for data related to the droplet discharge head and that is configured to store written data even when power is turned off; and a setting unit, wherein, the plurality of circuit boards includes at least a first circuit board and a second circuit board, each of the first and the second circuit boards has a same circuit pattern, and is made of a same material, the first circuit board includes a first nonvolatile memory, and the second circuit board includes a second nonvolatile memory, and the setting unit sets the first nonvolatile memory to write inhibition state and fixes the first nonvolatile memory as a read only nonvolatile memory, and sets the second nonvolatile memory to rewritable state.

11. The droplet discharge head according to claim 10, wherein the first nonvolatile memory is a read-only nonvolatile memory for data that should not be deleted and need not be rewritten, and the second nonvolatile memory is a read/write nonvolatile memory for data that is rewritten as required.

12. The droplet discharge head according to claim 10, wherein the nonvolatile memory is a nonvolatile memory in which a plurality of elements can be connected to a single I/O port.

13. The droplet discharge head according to claim 10, wherein the second nonvolatile memory is configured in either one of a rewritable manner and a manner in which the write inhibition state is fixable.

14. A droplet discharge apparatus comprising the droplet discharge head according to claim 10.

15. An image forming apparatus comprising the droplet discharge apparatus according to claim 14.

16. The droplet discharge head according to claim 10, further comprising:

a connecting device configured to switch to perform setting and fixing the first nonvolatile memory to the write inhibition state.

17. The droplet discharge head according to claim 10, wherein each of the first circuit board and the second circuit board is connected to a pressure generating element that drives nozzles of the droplet discharge head.

18. The droplet discharge head according to claim 10, wherein each of the first circuit board and the second circuit board is mounted with a nozzle selecting element that controls a nozzle row of the droplet discharge head.

* * * * *